US010446975B1

(12) United States Patent
Johnson

(10) Patent No.: US 10,446,975 B1
(45) Date of Patent: Oct. 15, 2019

(54) MALE CONNECTOR FOR NON-ARCING ELECTRICAL COUPLING

(71) Applicant: Littelfuse, Inc., Chicago, IL (US)

(72) Inventor: Brian Johnson, Cornwall (GB)

(73) Assignee: LITTELFUSE, INC., Chicago, IL (US)

( * ) Notice: Subject to any disclaimer, the term of this patent is extended or adjusted under 35 U.S.C. 154(b) by 0 days.

(21) Appl. No.: 16/040,997

(22) Filed: Jul. 20, 2018

(51) Int. Cl.
*H01R 13/03* (2006.01)
*H01R 13/53* (2006.01)
*H01R 13/11* (2006.01)
*H01R 101/00* (2006.01)

(52) U.S. Cl.
CPC ..... *H01R 13/53* (2013.01); *H01R 13/03* (2013.01); *H01R 13/112* (2013.01); *H01R 2101/00* (2013.01)

(58) Field of Classification Search
CPC ..... H01L 2224/13691; H01R 13/03; H01R 13/035; H01R 39/46; H05K 2201/0233; H05K 2201/0314
See application file for complete search history.

(56) References Cited

U.S. PATENT DOCUMENTS 3,880,486 A * 4/1975 Avakian ..... H05K 3/308 439/75
5,073,124 A * 12/1991 Powell ..... H01R 13/035 200/83 B
5,428,891 A * 7/1995 Samarov ..... H01R 23/6873 264/135
5,656,798 A * 8/1997 Kubo ..... H01L 21/486 174/263
6,102,742 A * 8/2000 Daly ..... H01R 13/6616 338/21
6,360,437 B1 * 3/2002 Fukumoto ..... C25D 5/10 29/825
6,623,288 B2 * 9/2003 Sakiyama ..... H01R 13/03 439/181
6,857,887 B1 * 2/2005 Belson ..... H01R 13/6616 439/181
7,470,154 B2 * 12/2008 Sato ..... H01R 13/03 439/693
9,966,685 B2 * 5/2018 Kim ..... H01R 12/714
2018/0034198 A1 * 2/2018 Lyon ..... H01R 13/53

* cited by examiner

*Primary Examiner* — Vanessa Girardi

(57) ABSTRACT

A non-arcing electrical coupling including a male connecter including an electrically conductive prong extending from an electrically insulating base member, the prong covered with an arc-mitigating coating formed of a resilient quantum tunneling compound, wherein the arc-mitigating coating exhibits a first electrical resistance when in an uncompressed state and exhibits a second electrical resistance when in a compressed state, the first electrical resistance greater than the second electrical resistance, and a female connecter including an electrically insulating base member defining a receptacle adapted to receive the prong of the male connecter, the receptacle containing an electrically conductive clip comprising a pair of electrically conductive tines adapted to compress at least a portion of the arc-mitigating coating when the prong is inserted into the receptacle.

20 Claims, 2 Drawing Sheets

MALE CONNECTOR FOR NON-ARCING ELECTRICAL COUPLING

FIELD OF THE DISCLOSURE

The present disclosure relates generally to the field of circuit protection devices, and relates more particularly to a non-arcing electrical coupling.

FIELD OF THE DISCLOSURE

A typical electrical coupling includes a male connecter and a female connecter that are adapted for mating engagement with one another to establish an electrical connection between a source of electrical power and an electrical device. The male connecter generally includes one or more electrically conductive pins or prongs (hereinafter collectively referred to as prongs), and the female connecter generally includes a corresponding number of sockets or receptacles (hereinafter collectively referred to as receptacles) for receiving the prongs of the male connecter. When a prong of a male connecter is inserted into the receptacle of a female connecter, an electrical connection is established therebetween. Conversely, when the prong of the male connecter is removed from the receptacle of the female connecter, the electrical connection is terminated.

In some instances, when a prong of a male connecter is withdrawn from a receptacle of a female connecter, an electrical arc may propagate through the air between the disconnected pin and receptacle while the components are still in close proximity to one another. Such electrical arcing can pose a significant safety risk, and is of particular concern in modern, high power electrical connection applications (e.g., plug-in electric vehicles). It is therefore desirable to provide an electrical coupling that eliminates or mitigates the occurrence of electrical arcing during disconnection.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

An exemplary embodiment of a non-arcing electrical coupling in accordance with the present disclosure may include a male connecter including an electrically conductive prong covered with an arc-mitigating coating, wherein the arc-mitigating coating exhibits a first electrical resistance when in an uncompressed state and exhibits a second electrical resistance when in a compressed state, the first electrical resistance greater than the second electrical resistance, and a female connecter including a receptacle adapted to receive the prong, the receptacle containing an electrically conductive clip adapted to compress at least a portion of the arc-mitigating coating when the prong is inserted into the receptacle.

Another exemplary embodiment of a non-arcing electrical coupling in accordance with the present disclosure may include a male connecter including an electrically conductive prong extending from an electrically insulating base member, the prong covered with an arc-mitigating coating formed of a resilient quantum tunneling compound, wherein the arc-mitigating coating exhibits a first electrical resistance when in an uncompressed state and exhibits a second electrical resistance when in a compressed state, the first electrical resistance greater than the second electrical resistance, and a female connecter including an electrically insulating base member defining a receptacle adapted to receive the prong of the male connecter, the receptacle containing an electrically conductive clip comprising a pair of electrically conductive tines adapted to compress at least a portion of the arc-mitigating coating when the prong is inserted into the receptacle.

An exemplary embodiment of a male connecter for a non-arcing electrical coupling in accordance with the present disclosure may include an electrically conductive prong extending from an electrically insulating base member, the prong covered with an arc-mitigating coating formed of a resilient quantum tunneling compound, wherein the arc-mitigating coating exhibits a first electrical resistance when in an uncompressed state and exhibits a second electrical resistance when in a compressed state, the first electrical resistance greater than the second electrical resistance.

DETAILED DESCRIPTION

Figure 1A:
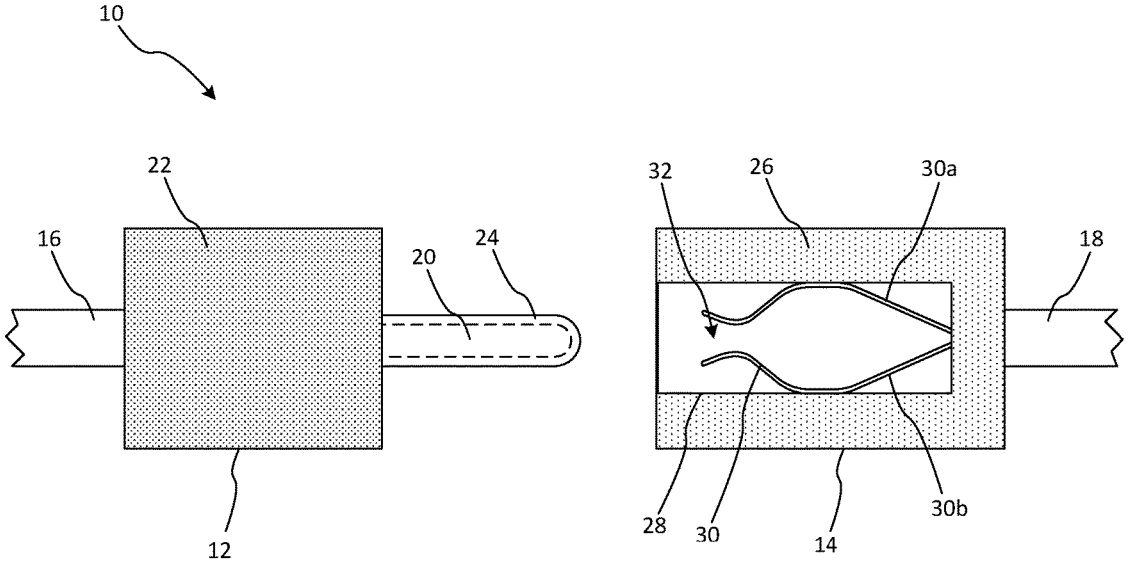
FIG. 1A is a cross-sectional side view illustrating a non-arcing electrical coupling in accordance with an exemplary embodiment of the present disclosure.

Embodiments of a non-arcing electrical coupling in accordance with the present disclosure will now be described more fully with reference to the accompanying drawings, in which preferred embodiments of the present disclosure are presented. The non-arcing electrical coupling of the present disclosure may, however, be embodied in many different forms and should not be construed as being limited to the embodiments set forth herein. Rather, these embodiments are provided so that this disclosure will convey certain exemplary aspects of the non-arcing electrical coupling to those skilled in the art. In the drawings, like numbers refer to like elements throughout unless otherwise noted.

Referring to FIG. 1A, a cross-sectional side view of a non-arcing electrical coupling (hereinafter "the coupling 10") in accordance with an exemplary embodiment of the present disclosure is shown. The coupling 10 may include a male connecter 12 and a female connecter 14 that are adapted for mating engagement with one another to provide an electrical connection between respective electrical conductors 16, 18 (e.g., wires, cables, etc.) to which the male and female connecters 12, 14 are connected. In a non-limiting, exemplary embodiment, the female connecter 14 and respective electrical conductor 18 may define, or may be integral components of, an electrical socket or receptacle of a plug-in electric vehicle (PEV), and the male connecter 12 and respective electrical conductor 16 may define, or may be integral components of, a charging cable adapted for use with the PEV. Those of ordinary skill in the art will appreciate that the coupling 10 may be implemented in various alternative applications that are too numerous to be listed within the present disclosure.

The male connecter 12 of the coupling 10 may include a prong 20 that projects or protrudes from an electrically insulating base member 22 and that is electrically connected to the electrical conductor 16. The prong 20 may be formed of any suitable, electrically conductive material (e.g., copper, tin, gold, silver, etc.). Only a single prong 20 is shown in FIG. 1A, but those of ordinary skill in the art will appreciate that the male connecter 12 may include a plurality of similar prongs for providing a more robust electrical connection.

The prong 20 may be covered with a resilient, arc-mitigating coating 24 formed of a quantum tunneling compound (QTC). As will be familiar to those of ordinary skill in the art, QTCs are typically resilient rubber compounds that are loaded with particles of electrically conductive materials, which may include, but are not limited to, silver and nickel. When a QTC is in a natural, uncompressed state, the conductive particles within the QTC are relatively far apart from one another, and the electrical resistance of the QTC is therefore relatively high. However, when a QTC is compressed, the conductive particles within the QTC are moved relatively closer to one another, and the electrical resistance of the QTC is therefore relatively lower than in the uncompressed state.

The arc-mitigating coating 24 may have a substantially uniform thickness (e.g., in a range of 0.1 millimeters to 1 millimeter) and may cover substantially the entire surface of the prong 20. This is not intended to be limiting. In various alternative embodiments of the male connecter 12, the arc-mitigating coating 24 may have a variable thickness and/or may only cover one or more discrete portions of the prong 20.

The female connecter 14 of the coupling 10 may include an electrically insulating base member 26 that includes or defines a receptacle 28 adapted for receiving the prong 20 of the male connecter 12. Only a single receptacle 28 is shown in FIG. 1A, but those of ordinary skill in the art will appreciate that the female connecter 14 may include a plurality of similar receptacles for receiving a corresponding plurality of prongs of the male connecter 12.

The female connecter 14 may further include a resilient, electrically conductive clip 30 disposed within the receptacle 28 and electrically connected to the electrical conductor 18. The clip 30 may be adapted to receive and releasably engage the prong 20 of the male connecter 12 as further described below. The clip 30 may include resilient or flexible tines 30*a*, 30*b* that may engage respective sides of the receptacle 28 and that are bent toward one another to define a relatively narrow gap 32 between portions thereof. For example, the gap 32 may be narrower than a diameter or thickness of the prong 20. Terminal ends of the tines 30*a*, 30*b* may be bent or angled away from one another to facilitate acceptance of the prong 20 in a funnel-like fashion as further described below. The tines 30*a*, 30*b* may be formed of any suitable, electrically conductive material (e.g., copper, tin, gold, silver, etc.).

Figure 1B:
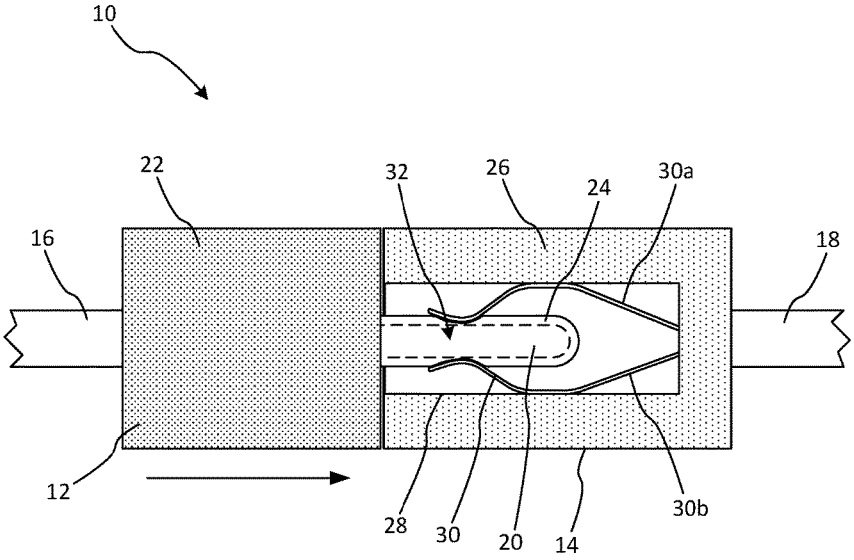
FIG. 1B is a cross-sectional side view illustrating the non-arcing electrical coupling shown in FIG. 1A with a male connecter of the coupling mated with a female connecter of the coupling.

When the prong 20 is inserted into the receptacle 28, the tip of the prong 20 may engage interior surfaces of the angled, terminal ends of the tines 30*a*, 30*b* and may be smoothly guided into the gap 32. As the prong 20 is inserted further into the gap 32, the normal force of the tines 30*a*, 30*b* acting on the arc-mitigating coating 24 of the prong 20 may be sufficient to compress the arc-mitigating coating 24 against the surface of the prong 20 as shown in FIG. 1B. Thus, as described above, the compressed portions of the arc-mitigating coating 24 may become electrically conductive (or more electrically conductive relative to the uncompressed state shown in FIG. 1A), thereby providing an electrically conductive pathway between the tines 30*a*, 30*b* and the prong 20 and establishing an electrical connection between the conductor 16 of the male connecter 12 and the conductor 18 of the female connecter 14. This connection may be maintained while the prong 20 is disposed within the receptacle 28 and the arc-mitigating coating 24 is held in compression by the clip 30.

Figure 2A:
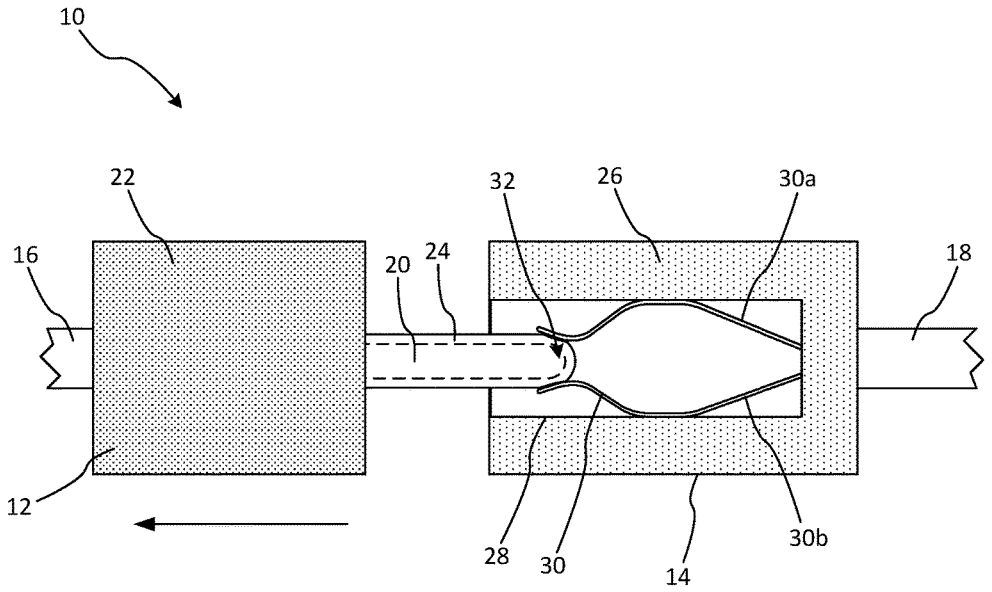
FIG. 2A is a cross-sectional side view illustrating the non-arcing electrical coupling shown in FIG. 1A with the male connecter of the coupling being separated from the female connecter of the coupling.
Figure 2B:
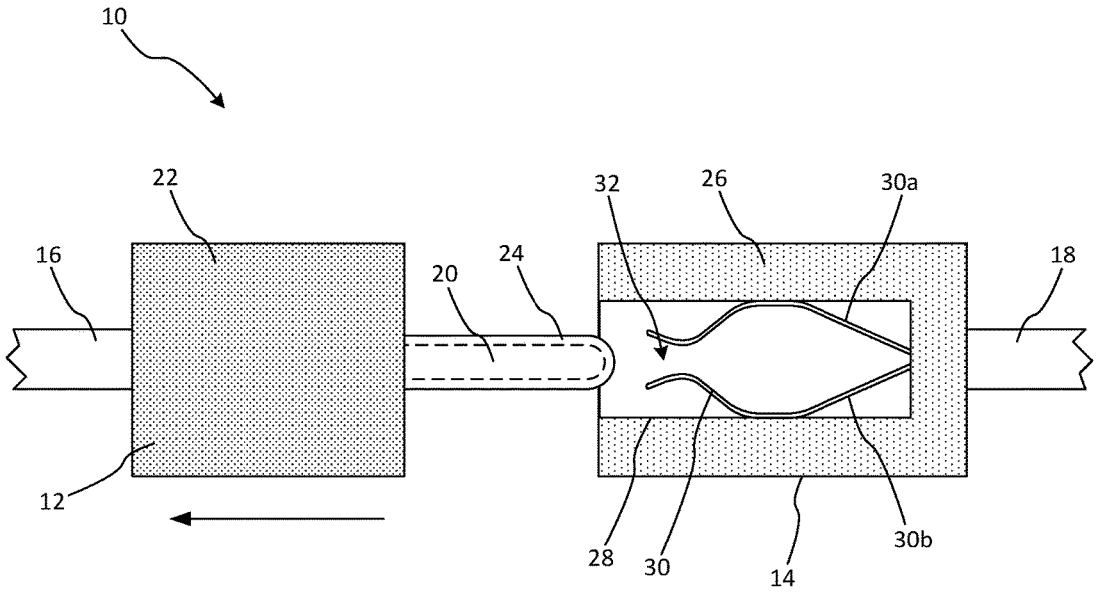
FIG. 2B is a cross-sectional side view illustrating the non-arcing electrical coupling shown in FIG. 1A with the male connecter of the coupling fully separated from the female connecter of the coupling.

When the male connecter 12 is separated from the female connecter 14, the prong 20 may be may be withdrawn from the clip 30 as shown in FIG. 2A. As the tip of the prong 20 exists the gap 32, the force imparted on the arc-mitigating coating 24 by the tines 30*a*, 30*b* is relieved, allowing the resilient, arc-mitigating coating 24 to expand to its uncompressed thickness. The arc-mitigating coating 24 thus returns to its high-resistance, electrically insulating state, thereby preventing or mitigating the formation of an electrical arc between the separated clip 30 and prong 20. The coupling 10 of the present disclosure therefore provides a safer alternative to conventional electrical couplings which are susceptible to the propagation of electrical arcs during disconnection. This benefit is of particular importance in the context of modern, high power electrical connection applications (e.g., PEVs) in which electrical arcing can pose a significant safety hazard.

While the clip 30 has been described above and shown in the figures as including a pair of resilient tines 30*a*, 30*b* for forcibly and releasably engaging the prong 20 of the male connecter, it is contemplated that the clip 30 may be implemented using any number of alternative structures or elements that may serve the same purpose in the context of the coupling 10 as described above. For example, the clip 30 may be embodied by any type of structure or arrangement of structures that releasably impinges upon, is biased against, or otherwise compresses at least a portion of the arc-mitigating coating 24 of the prong 20 to provide an electrically conductive pathway between the clip 30 and the prong 20 when the male connecter 12 is mated with the female connecter 14. Examples of such structures include, but are not limited to, various types of resilient or rigid clamps, cuffs, barrels, detents, ridges, castellations, protrusions, etc., any of which may be spring-loaded or otherwise biased against the arc-mitigating coating 24 of the prong 20 when the prong 20 is inserted into the receptacle 28.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A male connecter for a non-arcing electrical coupling, the male connecter comprising an electrically conductive prong extending from an electrically insulating base member, the prong covered with an arc-mitigating coating formed of a resilient quantum tunneling compound, wherein the arc-mitigating coating exhibits a first electrical resistance when in an uncompressed state and exhibits a second electrical resistance when in a compressed state, the first electrical resistance greater than the second electrical resistance.

2. The non-arcing electrical coupling of claim 1, wherein the quantum tunneling compound comprising a resilient rubber compound loaded with particles of electrically conductive material.

3. The non-arcing electrical coupling of claim 1, wherein the arc-mitigating coating has a uniform thickness.

4. The non-arcing electrical coupling of claim 3, wherein the thickness is in a range from 0.1 millimeters to 1 millimeter.

5. A non-arcing electrical coupling comprising:

a male connecter comprising an electrically conductive prong covered with an arc-mitigating coating, wherein the arc-mitigating coating exhibits a first electrical resistance when in an uncompressed state and exhibits a second electrical resistance when in a compressed state, the first electrical resistance greater than the second electrical resistance; and a female connecter comprising a receptacle adapted to receive the prong, the receptacle containing an electrically conductive clip adapted to compress at least a portion of the arc-mitigating coating when the prong is inserted into the receptacle.

6. The non-arcing electrical coupling of claim 5, wherein the male connecter comprises a plurality of electrically conductive prongs.

7. The non-arcing electrical coupling of claim 5, wherein the arc-mitigating coating is formed of a quantum tunneling compound.

8. The non-arcing electrical coupling of claim 7, wherein the quantum tunneling compound comprising a resilient rubber compound loaded with particles of electrically conductive material.

9. The non-arcing electrical coupling of claim 5, wherein the arc-mitigating coating has a uniform thickness.

10. The non-arcing electrical coupling of claim 9, wherein the thickness is in a range from 0.1 millimeters to 1 millimeter.

11. The non-arcing electrical coupling of claim 5, wherein the clip comprises a pair of tines defining a gap therebetween for receiving the prong, wherein the tines forcibly engage the prong when the prong is disposed within the gap.

12. The non-arcing electrical coupling of claim 11, wherein the tines are flexible and engage opposing sides of the receptacle.

13. The non-arcing electrical coupling of claim 11, wherein terminal ends of the tines are angled away from one another for receiving the prong in a funnel-like fashion.

14. A non-arcing electrical coupling comprising:

a male connecter comprising an electrically conductive prong extending from an electrically insulating base member, the prong covered with an arc-mitigating coating formed of a resilient quantum tunneling compound, wherein the arc-mitigating coating exhibits a first electrical resistance when in an uncompressed state and exhibits a second electrical resistance when in a compressed state, the first electrical resistance greater than the second electrical resistance; and a female connecter comprising an electrically insulating base member defining a receptacle adapted to receive the prong of the male connecter, the receptacle containing an electrically conductive clip comprising a pair of electrically conductive tines adapted to compress at least a portion of the arc-mitigating coating when the prong is inserted into the receptacle.

15. The non-arcing electrical coupling of claim 14, wherein the quantum tunneling compound comprising a resilient rubber compound loaded with particles of electrically conductive material.

16. The non-arcing electrical coupling of claim 14, wherein the male connecter comprises a plurality of electrically conductive prongs.

17. The non-arcing electrical coupling of claim 14, wherein the tines are flexible and engage opposing sides of the receptacle.

18. The non-arcing electrical coupling of claim 14, wherein terminal ends of the tines are angled away from one another for receiving the prong in a funnel-like fashion.

19. The non-arcing electrical coupling of claim 14, wherein the arc-mitigating coating has a uniform thickness.

20. The non-arcing electrical coupling of claim 19, wherein the thickness is in a range from 0.1 millimeters to 1 millimeter.

* * * * *